US009200604B2

(12) United States Patent
Derenthal et al.

(10) Patent No.: US 9,200,604 B2
(45) **Date of Patent: *Dec. 1, 2015**

(54) FUEL INJECTOR HAVING PRESS-FITTING STRUCTURES

(75) Inventors: Marc-Jean Derenthal, Gundelsheim (DE); Wolfgang Koschwitz, Litzendorf (DE); Johann Bayer, Strullendorf (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1307 days.

This patent is subject to a terminal disclaimer.

(21) Appl. No.: 12/308,633

(22) PCT Filed: Feb. 1, 2008

(86) PCT No.: PCT/EP2008/051293

§ 371 (c)(1),
(2), (4) Date: Jun. 17, 2011

(87) PCT Pub. No.: WO2008/101791

PCT Pub. Date: Aug. 28, 2008

(65) Prior Publication Data

US 2011/0259299 A1 Oct. 27, 2011

(30) Foreign Application Priority Data

Feb. 23, 2007 (DE) ..... 10 2007 008 863

(51) Int. Cl.
*F02M 51/06* (2006.01)
*F02M 61/16* (2006.01)

(52) U.S. Cl.
CPC ..... *F02M 51/0682* (2013.01); *F02M 51/061* (2013.01); *F02M 61/168* (2013.01); *F02M 2200/8061* (2013.01)

(58) Field of Classification Search
CPC ..... F02M 61/168; F02M 2200/505; F02M 2200/8061; F02M 51/0667; F02M 51/0671; F16L 13/14; F16L 13/141
USPC ..... 123/445; 239/584, 585.1–585.5, 239/533.1–533.15; 138/109; 251/129.15, 251/129.21; 137/15.09; 29/505–525; 285/382, 256
See application file for complete search history.

(56) References Cited

U.S. PATENT DOCUMENTS 3,425,719 A * 2/1969 Burton ..... 285/382.2
4,007,880 A * 2/1977 Hans et al. ..... 239/585.5

(Continued)

FOREIGN PATENT DOCUMENTS

DE 101 03 933 8/2002
DE 103 34 785 2/2005

(Continued)

*Primary Examiner* — Hai Huynh
*Assistant Examiner* — Gonzalo Laguarda
(74) *Attorney, Agent, or Firm* — Kenyon & Kenyon LLP

(57) ABSTRACT

A fuel injector for fuel-injection systems of internal combustion engines. The fuel injector includes an electromagnetic actuating element having a solenoid coil, a core and a valve cover as external solenoid circuit component, and a movable valve-closure element, which cooperates with a valve-seat surface assigned to a valve-seat body. The core and a connection pipe are fixedly connected in an inner opening of a thin-walled valve sleeve by being pressed into place, and the valve cover at the outer circumference of the valve sleeve is firmly connected to the valve sleeve by being pressed onto it. The firm press-fitted connection of in each case two of these metallic components of the fuel injector is characterized by the fact that at least one of the partner components has in its press-fitting region a structure with score marks, and/or the particular press-fitting region has an intake rounding in at least one transition to an adjoining component section. To safely contain abrasion particles produced in the press-fitting action, starting from the press-fitting region of a partner component, first a recessed region adjoins, which is followed by a press lip, which radially projects further to the outside on the outer contour of this one component partner.

10 Claims, 4 Drawing Sheets

(56) References Cited

U.S. PATENT DOCUMENTS

| | | | | |
|---|---|---|---|---|
| 5,634,597 | A * | 6/1997 | Krohn et al. | 239/585.5 |
| 6,874,710 | B2 * | 4/2005 | Ishii et al. | 239/585.1 |
| 6,978,950 | B2 * | 12/2005 | Bierstaker et al. | 239/585.1 |
| 6,988,681 | B2 * | 1/2006 | Reiter | 239/584 |
| 7,128,281 | B2 * | 10/2006 | Cho et al. | 239/585.1 |
| 7,204,433 | B2 * | 4/2007 | Kobayashi et al. | 239/533.2 |
| 7,303,214 | B2 * | 12/2007 | Bayer et al. | 285/328 |
| 2001/0030248 | A1 * | 10/2001 | Popp | 239/533.2 |
| 2002/0030125 | A1 | 3/2002 | D'Arrigo | |
| 2002/0043575 | A1 * | 4/2002 | Sekine et al. | 239/585.1 |
| 2002/0083928 | A1 | 7/2002 | Dallmeyer et al. | |
| 2003/0102388 | A1 | 6/2003 | Sugiyama | |
| 2003/0141390 | A1 | 7/2003 | Matsuo et al. | |
| 2003/0164411 | A1 * | 9/2003 | Reiter | 239/533.12 |
| 2004/0195384 | A1 * | 10/2004 | Bierstaker et al. | 239/533.2 |
| 2005/0045748 | A1 * | 3/2005 | Kobayashi et al. | 239/533.2 |
| 2005/0045749 | A1 * | 3/2005 | Kobayashi et al. | 239/585.1 |
| 2006/0113406 | A1 * | 6/2006 | Ganser | 239/533.2 |
| 2006/0283984 | A1 * | 12/2006 | Enke | 239/533.2 |
| 2007/0028613 | A1 * | 2/2007 | Schuster et al. | 60/553 |
| 2007/0057095 | A1 * | 3/2007 | Bayer et al. | 239/585.1 |
| 2009/0236448 | A1 * | 9/2009 | Burkhard et al. | 239/575 |
| 2010/0006068 | A1 * | 1/2010 | Maier et al. | 123/472 |
| 2010/0313850 | A1 * | 12/2010 | Kondo et al. | 123/445 |

FOREIGN PATENT DOCUMENTS

| | | |
|---|---|---|
| DE | 103 49 633 | 5/2005 |
| DE | 10 2004 010174 | 9/2005 |
| EP | 1 503 390 | 2/2005 |
| EP | 1 632 921 | 3/2006 |
| JP | 2002-534639 | 10/2002 |
| JP | 2003-166452 | 6/2003 |
| JP | 2004-518066 | 6/2004 |
| JP | 2007-500301 | 1/2007 |

* cited by examiner

FUEL INJECTOR HAVING PRESS-FITTING STRUCTURES

FIELD OF THE INVENTION

The present invention relate to a fuel injector.

BACKGROUND INFORMATION

A fuel injector which includes an electromagnetic actuation element having a solenoid coil, an internal pole and an external magnetic circuit component as well as a movable valve-closure element, which cooperates with a valve seat assigned to a valve-seat body, is already known from DE 199 00 405 A1. The valve-seat body and the internal pole are placed in an inner opening of a thin-walled valve sleeve, and the solenoid coil and the external magnetic circuit component are positioned on the outer periphery of the valve sleeve.

To affix the individual components inside and on the valve sleeve, the magnetic circuit component in the form of a magnetic cup is first slipped over the valve sleeve and then the valve-seat body is pressed into the inner opening of the valve sleeve, so that a firm connection of valve sleeve and magnetic circuit component is achieved solely by the pressing-in of the valve-seat body. Once an axially movable valve needle has been installed inside the valve sleeve, the internal pole is fixed in place inside the valve sleeve by pressing it in. When the magnetic-circuit component is press-fitted onto the valve sleeve solely by pressing the valve-seat body in, there is a high risk that the press-fitted connection may loosen. Pressing the internal pole into the valve sleeve causes undesired cold welds in the press-fitting region.

SUMMARY OF THE INVENTION

The fuel injector of the present invention having the features described herein has the advantage that it is able to be produced inexpensively and in a particularly simple manner.

According to the present invention, the firm press-fitted connection of at least two metallic components of the fuel injector is characterized by the fact that when the parts to be joined slide against each other during the press-fitting operation, the abrasion particles possibly produced are safely and reliably caught and contained in a cavity produced by a recessed region and a press lip at the outer contour of one of the parts to be joined. This makes it possible to dispense with a rinsing or some other cleaning process that entails extra work. The abraded particles contained in the cavity in the recessed region are stored safely and therefore cannot travel to other regions of the fuel injector to cause functional impairments there.

It is advantageous that it is possible to produce press-fitted connections between metallic partner components using cost-effective parts that are provided as deep-drawn or lathed components, such connections remaining tight and sealed in a safe and reliable manner over a long period of time while avoiding cold seals. The press-fitted connections can be produced in a very simple and cost-effective manner, since known and normally required separate work processes such as coating or oiling for improved joining of the partner components, or heating of the partner components for shrink-fitting may advantageously be dispensed with. At least one of the partner components has a pattern with grooves in its press-fitting region, and/or the particular press-fitting region has an intake rounding in at least one transition to an adjoining component section.

Advantageous further refinements of and improvements to the fuel injector described herein are rendered possible by the measures further described herein.

If the partner components are unable to expand or be compressed due to their rigidness, or if they are too soft in their material as is the case with magnetically soft chromium steel, which is typically used for the different components of an electromagnetically driven fuel injector, then cold welds ("jams") will most likely develop in known press-fitted connections during the pressing-in step of the joining operation, which, however, can be avoided by the measures of the present invention, specifically in the case of components made of magnetically soft chromium steel. Labor-intensive, precise and costly machining processes, such as fine grinding or honing, by which the tolerances of the components could be narrowed and the press-fitted connections improved at considerable expense, may be dispensed with.

In an especially advantageous manner, at least the respective press-fitting regions of the metallic partner components to be press-fitted are cleaned using a cleaner. Advantageous lubricant reservoirs result in conjunction with the grooves in the individual press-fitting region. The anti-corrosion general-purpose cleaners SurTec® 104 or SurTec® 089 or Hitec® E536 of the Ethyl Corp. are advantageously used as cleaners.

Exemplary embodiments of the present invention are depicted in simplified form in the drawing and explained in greater detail in the description below.

DETAILED DESCRIPTION

For a better understanding of the measures according to the present invention, a fuel injector according to the related art together with its basic components is explained in the following text with the aid of FIG. 1.

Figure 1:
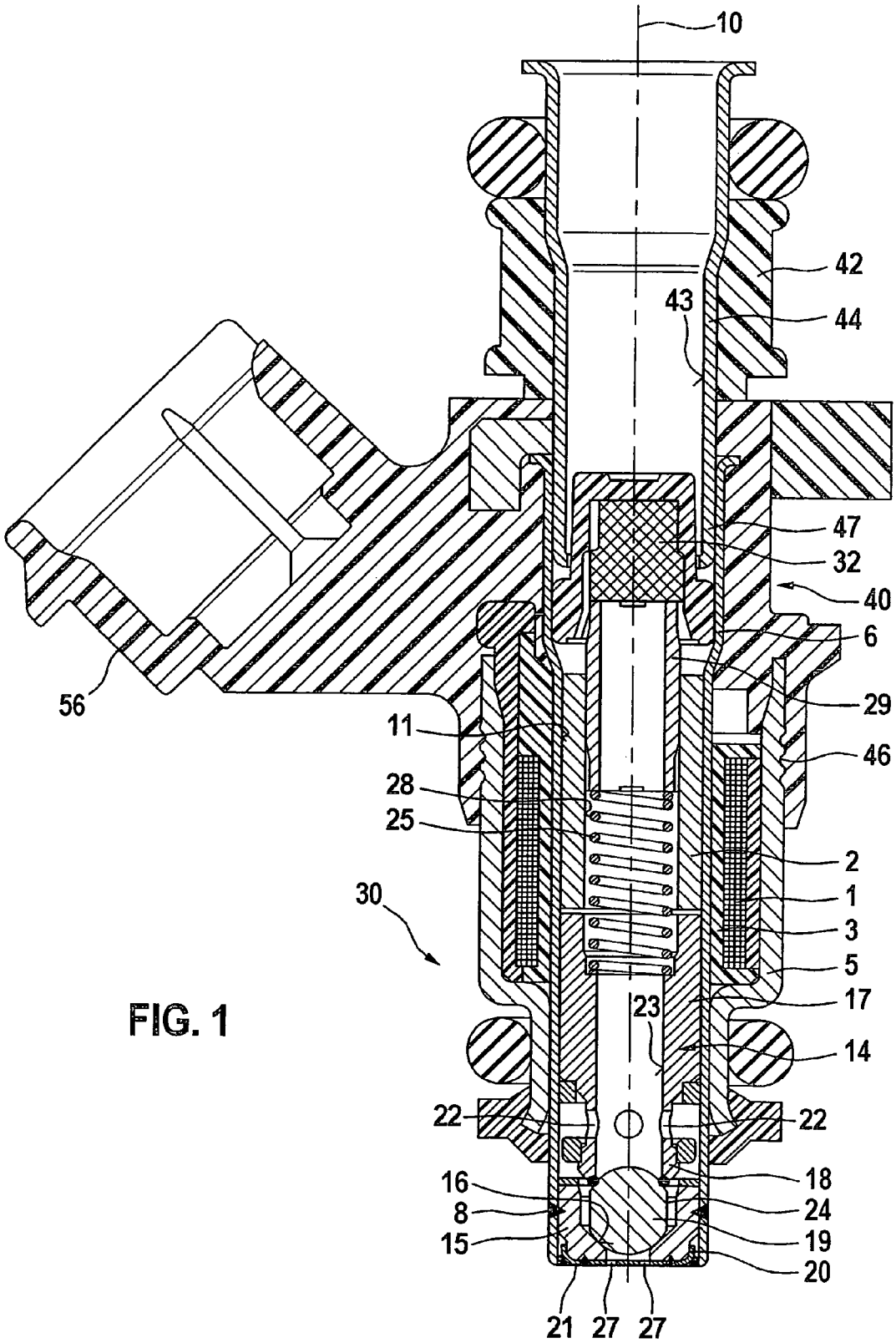
FIG. 1 shows a fuel injector according to the related art.

The electromagnetically activatable valve in the form of a fuel injector for fuel-injection systems of mixture-compressing, externally ignited combustion engines, shown in FIG. 1 by way of example, has a largely tubular core 2, which is surrounded by a solenoid coil 1 and functions as internal pole and partly as fuel conduit. In the circumferential direction, solenoid coil 1 is completely surrounded by an outer sleeve-shaped and stepped, e.g., ferromagnetic, valve cover 5, which constitutes an outer magnetic circuit component functioning as external pole and is implemented in the form of a magnetic cup. Together, solenoid coil 1, core 2 and valve cover 5 form an electrically excitable actuating element.

While solenoid coil 1 embedded in a coil body 3 encloses a valve sleeve 6 on the outside, core 2 is inserted in an inner opening 11 of valve sleeve 6 extending concentrically with a longitudinal valve axis 10. The, for example, ferritic valve sleeve 6 is elongated longitudinally and has thin walls. Opening 11 also serves as guide opening for a valve needle 14, which is axially displaceable along longitudinal valve axis 10. In the axial direction, valve sleeve 6 extends across more than one half of the total axial extension of the fuel injector, for instance.

In addition to core 2 and valve needle 14, a valve-seat body 15 is also disposed in opening 11, which is fixed in place on valve sleeve 6 with the aid of a welding seam 8, for instance. Valve-seat body 15 has a fixed valve-seat surface 16 as valve seat. Valve needle 14 is formed by, for instance, a tubular armature section 17, a likewise tubular needle section 18, and a spherical valve-closure element 19, valve-closure element 19 being permanently joined to needle section 18 by a welding seam, for example. Mounted on the downstream end face of valve-seat body 15 is a, for instance, cup-shaped apertured spray disk 21 whose bent and circumferentially extending holding rim 20 is directed in the upward direction, counter to the direction of the flow. The firm connection of valve-seat body 15 and apertured spray disk 21 is realized by a circumferential, sealing welding seam, for example. One or several transverse openings 22 is/are provided in needle section 18 of valve needle 14, so that fuel flowing through armature section 17 in an inner longitudinal bore 23 is able to exit and flow along valve-closure element 19, via flattened regions 24, for instance, to valve-seat surface 16.

The fuel injector is actuated electromagnetically, in the known manner. For the axial movement of valve needle 14 and thus for opening the fuel injector counter to the spring force of a restoring spring 25 that engages with valve needle 14, or for closing the fuel injector, use is made of the electromagnetic circuit having solenoid coil 1, internal core 2, external valve coat 5, and armature section 17. Via the end facing away from valve-closure element 19, armature section 17 is oriented toward core 2.

Spherical valve-closure element 19 cooperates with valve-seat surface 16 of valve-seat body 15, which tapers frustoconically in the direction of the flow and is formed downstream from a guide opening in valve-seat body 15 in the axial direction. Apertured spray disk 21 has at least one, e.g., four, spray-discharge orifices 27 formed by eroding, laser drilling or stamping, for example.

The insertion depth of core 2 in the fuel injector is decisive for the travel of valve needle 14, among others. When solenoid coil 1 is not energized, the one end position of valve needle 14 is defined by the contact of valve-closure element 19 with valve seat surface 16 of valve-seat body 15, while when solenoid coil 1 is energized, the other end position of valve needle 14 results from the contact of armature section 17 with the downstream core end. The travel is set by an axial displacement of core 2, which is produced by a metal-cutting method such as turning, for example, and is subsequently firmly joined to valve sleeve 6 according to the desired position.

In addition to restoring spring 25, an adjustment element in the form of an adjustment sleeve 29 is inserted into a flow bore 28 of core 2, which extends concentrically with respect to longitudinal valve axis 10 and serves as conduit for the fuel in the direction of valve-seat surface 16. Adjustment sleeve 29 adjusts the initial spring force of restoring spring 25 resting against adjustment sleeve 29, which spring in turn is resting against valve needle 14 via its opposite side, an adjustment of the dynamic spray-discharge quantity being implemented by adjustment sleeve 29, as well. A fuel filter 32 is disposed above adjustment sleeve 29 inside valve sleeve 6.

The fuel injector described up to this point is characterized by its especially compact design, so that a very small, manageable fuel injector is produced. These components form a preassembled, self-contained module, which is referred to as functional component 30 hereinafter. Functional component 30 thus essentially includes electromagnetic circuit 1, 2, 5, and a sealing valve (valve-closure element 19, valve-seat body 15) followed by a jet-conditioning element (apertured spray disk 21), as well as valve sleeve 6 as base element.

Independently of functional component 30, a second module is produced, which is referred to as connecting component 40 in the following text. Connecting component 40 is mainly characterized by the fact that it includes the electrical and the hydraulic connection of the fuel injector. Connecting component 40, which is designed as plastic component for the most part, therefore has a tubular base element 42, which functions as fuel intake nipple. A flow bore 43, extending concentrically with longitudinal valve axis 10, of an inner connection pipe 44 in base element 42 is used as fuel intake, through which fuel is flowing in the axial direction from the inflow-side end of the fuel injector.

A hydraulic connection of connecting component 40 and functional component 30 in the fully installed fuel injector is achieved in that flow bores 43 and 28 of both modules are placed next to one another in such a way that an unimpeded flow of the fuel is ensured. When connecting component 40 is mounted on functional component 30, a lower end 47 of connection pipe 44 projects into opening 11 of valve sleeve 6 so as to increase the stability of the connection. Base element 42 made of plastic can be sputtered onto functional component 30, so that the plastic directly surrounds parts of valve sleeve 6 and valve cover 5. Reliable sealing between functional component 30 and base element 42 of connecting component 40 is obtained via, for instance, a labyrinth seal 46 on the periphery of valve cover 5.

Another part of base element 42 is a likewise sputtered-on electric connector plug 56. The contact elements are electrically connected to solenoid coil 1 at their ends lying across from connector plug 56.

Figure 2:
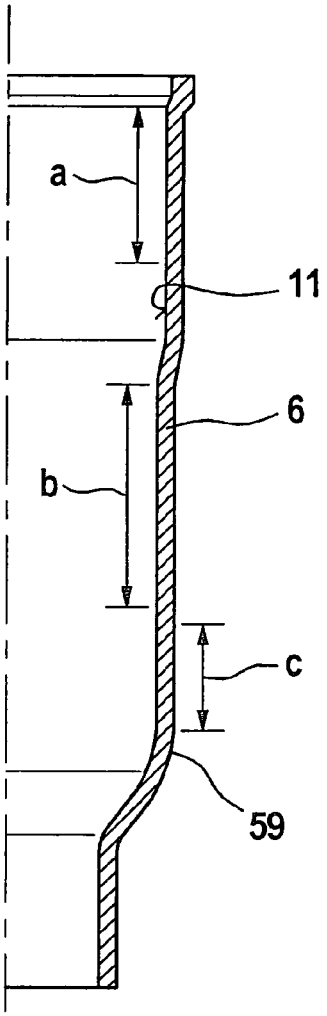
FIG. 2 shows a detail view of a valve sleeve.
Figure 3:
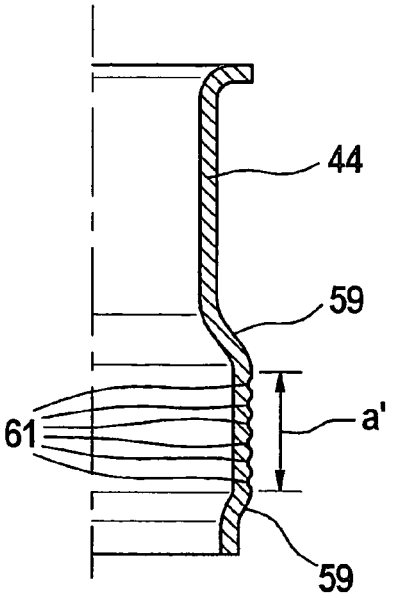
FIG. 3 shows a detail view of a connection pipe.
Figure 4:
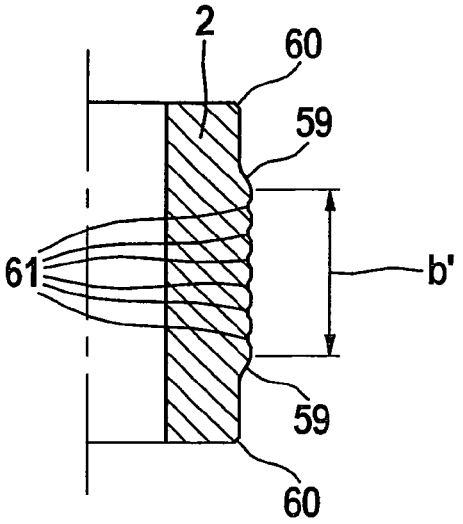
FIG. 4 shows a detail view of a core functioning as internal pole.
Figure 5:
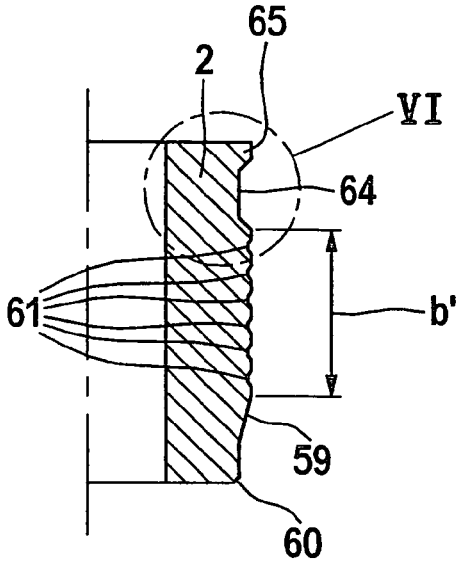
FIG. 5 shows a detail view of a core functioning as internal pole, provided with a first development of a press lip.
Figure 6:
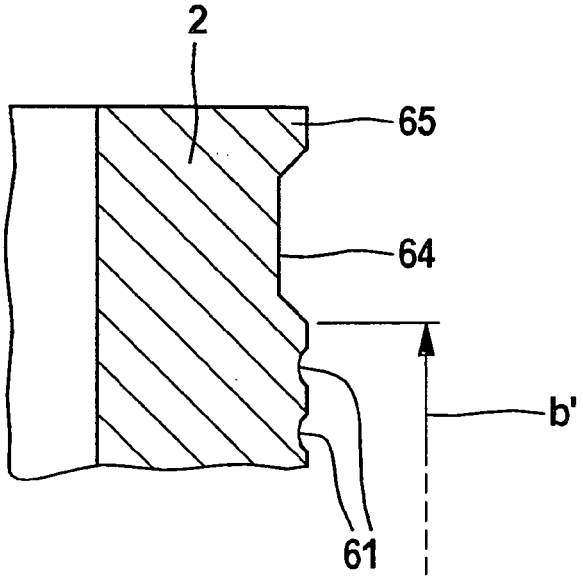
FIG. 6 shows an enlarged view of cutaway portion VI in FIG. 5.
Figure 7:
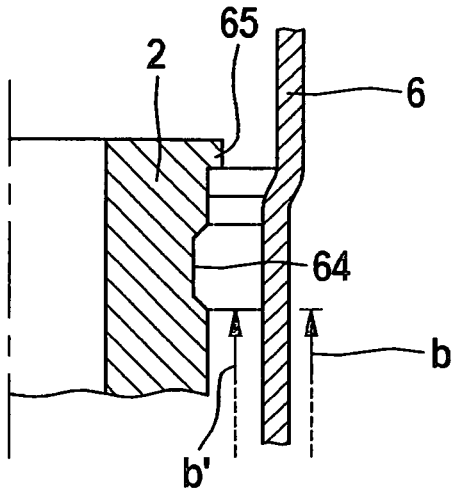
FIG. 7 shows a detail view of a core functioning as internal pole, provided with a second development of a press lip.
Figure 8:
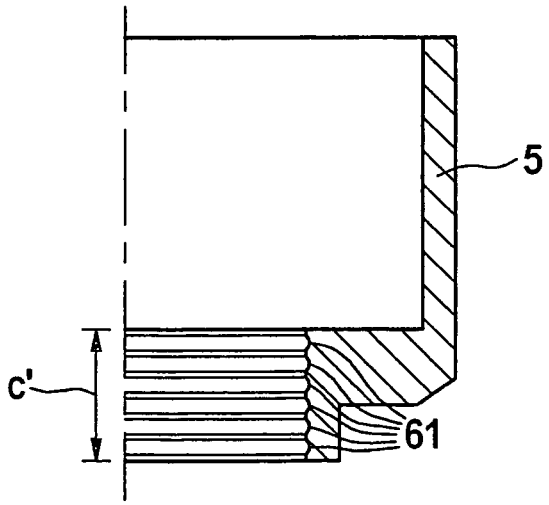
FIG. 8 shows a detail view of a valve cover in the form of a magnetic cup.

FIGS. 2 through 8 show metal components of the fuel injector, each being firmly connected to at least one other metal component, using pressure. FIG. 2 shows a detail view of a valve sleeve 6; FIG. 3 shows a detail view of a connection pipe 44; FIG. 4 shows a detail view of a core 2 functioning as internal pole; FIGS. 5 through 7 show developments according to the present invention of core 2 functioning as internal pole and having press lips 65; and FIG. 8 shows a detail view of a valve cover 5, which is realized in the form of a magnetic cup.

Press fits between the two components to be mounted lend themselves for the firm connection of metal components in the fuel injector. However, as a rule press fits cause plastic or elastic buckling or stretching of the components, depending on the position tolerance, the material and component geometry. If the partner components are unable to expand or shrink because of their rigidity, or if they are too soft in their the material, as in the case of magnetically soft chromium steel as especially suitable stainless steel, for example, then cold welds ("jams") will most likely occur during the joining process of the press-fitting action. Furthermore, the installation conditions of the partner components have to be taken into account. If the press-fitted connection is subjected to internal pressure, for instance in the installed state, then this can lead to expansions and widening. This in turn entails the risk that the press-fitted connection will loosen and, in the worst case, that the connection will come apart. To prevent this, the highest possible pressure force should be generated, which, however, increases the tendency of the components to form cold welds. Of course, it is possible to narrow the tolerances and improve the press-fitted connections by labor-intensive precise and costly processing methods such as fine grinding or honing.

However, the goal consists of producing press-fitted connections between metallic component parts using cost-effective parts, if possible, that are provided as lathed components, such connections remaining tight and sealed in a safe and reliable manner over a long period of time while avoiding cold seals. However, the press-fitted connections should be produced in a very simple and cost-effective manner, which is why a separate working step of coating, oiling or heating the partner components for shrink-fitting purposes is dispensed with.

In FIG. 2 a thin-walled valve sleeve 6 is shown by way of example, which extends across a large portion of the axial length of the fuel injector and into which connection pipe 44 (FIG. 3) is able to be press-fitted in a region a, and core 2 (FIGS. 4 through 7) is able to be press-fitted in a region b, and onto which valve cover 5 (FIG. 8) is able to be press-fitted in a region c.

In a corresponding manner, connection pipe 44 according to FIG. 3 has an outer press-fitting region a', which corresponds to region a to form a press-fitted connection when installed in valve sleeve 6. A and a' denote regions that are basically suitable for material contact in the press-fitted connection; however, it is by no means required that the press-fitted connection be implemented across the entire length of a and a'. Connection pipe 44 is to be installed in valve sleeve 6 with as little pressing-in force as possible. Due to the development of a defined short press-fitting region a', the press-in length is able to be minimized from the outset. Press-fitting region a' of connection pipe 44 is elevated in comparison with the adjoining sections of connection pipe 44. Intake roundings 59, which have a relatively large radius, are provided in the transition of press-fitting region a' to the sections adjoining on both sides in the axial direction. The radii correspond to, for example, an angularity in the transitions of approximately 0.5° to 1.2°.

As an additional measure, chamfered- or groove-type score marks 61 are provided on the surface in press-fitting region a' of connection pipe 44, by which the zones of a potential cold weld are interrupted repeatedly. Disadvantageous "jamming zones" of the press-fitted connection are largely avoided in this manner. Furthermore, score marks 61, which are circumferential, for example, reduce a high interference allowance since they are plastically deformed during the compression and level out slightly. Nevertheless, the produced profile of score marks 61 must have enough strength to still induce the expansion of valve sleeve 6 in a low interference allowance.

Core 2 according to FIG. 4 has an outer press-fitting region b', which forms a corresponding press-fitted connection with region b when installed in valve sleeve 6. B and b' denote regions that are basically suitable for material contact in the press-fitted connection; however, it is by no means required that the press-fitted connection be implemented over the full length of b and b'. Core 2 is to cause a minimum expansion of valve sleeve 6 during the pressing-in operation, but the maximum pressing-in force is to be restricted. Due to the development of a defined short press-fitting region b', the press-in length can be minimized from the outset. Press-fitting region b' of core 2 is elevated in comparison with the adjoining sections of core 2. Intake roundings 59, which have a relatively large radius, are provided in the transition of press-fitting region b' to the sections adjoining axially on both sides. The radii correspond to, for example, an angularity in the transitions of approximately 0.5° to 1.2°. In the transition of the lateral surface of core 2 to its end faces, core 2 may additionally have a circumferential chamfer 60 in each case, which provides improved insertion and centering of core 2.

In place of intake roundings 59 or as an additional measure, chamfered- or groove-type score marks 61 are provided on the surface in press-fitting region b' of core 2, by which the zones of potential cold welds are interrupted repeatedly. Disadvantageous "jamming zones" of the press-fitted connection are largely avoided in this manner. Furthermore, score marks 61, which are circumferential, for example, reduce a high interference allowance since they are plastically deformed during compression and level out slightly. Nevertheless, the produced profile of score marks 61 must have enough strength to still induce the expansion of valve sleeve 6 in a low interference allowance.

FIG. 5 shows a detail view of a core 2 functioning as internal pole, with a first development of a circumferential press lip 65 designed according to the present invention. Starting from press-fitting region b' having score marks 61, a region 64, which has a recessed, groove-type design on the outer contour, adjoins in the axial direction via an intake rounding 59 or a relatively sharp-edged transition; this region 64 in turn transitions to a region having a larger diameter, which functions as a press lip 65. FIG. 6 shows an enlarged view of section VI in FIG. 5 in the previously described section of core 2. The transitions from press-fitting region b' to recessed region 64 and from recessed region 64 to press lip 65 may be provided with intake roundings 59 (as illustrated in FIG. 4); however, they may also extend at an incline similar to a chamfer (FIG. 6) or have a stepped design.

When being pressed in, the partner components to be joined slide past one another. Due to the relatively soft material structure of the partner components, this sliding may cause abrasions, which could cause disadvantageous contamination of the fuel injector. In an advantageous manner, the contamination produced during the actual press-fit operation is retained by additional projecting press lip 65 and stored in the cavity produced by recessed region 64. As a result, rinsing or some other labor-intensive cleaning operation becomes unnecessary. The abraded particles enclosed in the cavity in recessed region 64 are stored safety and thus are unable to reach other regions of the fuel injector and cause functional losses there.

FIG. 7 shows a detail view of a core 2, which functions as internal pole and includes a second development of a press lip 65. This development is meant to show clearly that an adaptation of the outer diameter of press lip 65 as a function of the contour of the partner component to be joined—in this case, thin-walled valve sleeve 6—may be appropriate. While press lip 65 in the exemplary embodiment shown in FIGS. 5 and 6 has an outer diameter that corresponds to that of press-fitting region b', press lip 65 of the exemplary embodiment according to FIG. 7 radially projects beyond press-fitting region b'. For this purpose, recessed region 64 on the outer contour of core 2 is provided with, for example, two sections that may have different depths. In the radial direction, press lip 65 is wide enough to ensure reliable chambering of the abraded particles possibly produced in the press-fitting action. In the exemplary embodiment according to FIG. 7, press lip 65 projects by a bulge that is formed relative to press-fitting region b, the projection being proportionate to the increase in diameter provided on valve sleeve 6. The dashed lines in FIG. 7 are a schematic indication of the locations where core 2 is resting inside valve sleeve 6 in the pressed-in state, as a result of which a cavity is formed in recessed region 64 between core 2 and valve sleeve 6. In FIGS. 5 through 7, the components of core 2 and valve sleeve 6 have been selected merely by way of example; press lips 65 can be provided on all firm press-fitting connections of at least two metallic components 2, 5, 6, 44 of the fuel injector.

Valve cover 5 according to FIG. 8 accordingly has an inner press-fitting region c', which forms a corresponding press-fitted connection with region c when mounted on valve sleeve 6. C and c' denote regions that are basically suitable for material contact in the press-fitted connection; however, it is by no means necessary to implement the press-fitted connection across the full length of c and c'. In press-fitting region c' of valve cover 5, groove- or thin channel-type score marks 61 are provided on the surface, by which the zones of potential cold welds are interrupted repeatedly. Disadvantageous "jamming zones" of the press-fitted connection are largely prevented in this manner. In addition, score marks 61, which are circumferential, for instance, reduce a high interference fit, since they are plastically deformed during compression and flatten slightly. However, the produced profile of score marks 61 must be strong enough to induce sufficient expansion of valve sleeve 6 in a low interference allowance for the tight fit of core 2. The press-fit length is able to be minimized from the outset by forming a defined short press-fitting region c'. In contrast to the illustration in FIG. 8, press-fitting region c' of valve cover 5 may also be elevated in comparison with the adjoining sections of valve cover 5, thereby defining maximum press-fitting region c' even more precisely.

For instance on an axial side on valve sleeve 6, the transition of press-fitting region c is provided with an intake rounding 59, which has a relatively large radius. For example, the radius corresponds to an angularity in the transition of approximately 0.5° to 1.2°.

In addition to the measures for producing a firm press-fitted connection between at least two metallic components 2, 5, 6, 44 of the fuel injector by providing a pattern of score marks 61 in press-fitting region a, b, c, a', b', c' and/or by the provision of an intake rounding 59 in at least one transition from the particular press-fitting region a, b, c, a', b', c' to an adjoining component section, an additional measure may contribute to an improvement in the metallic press-fitted connection in an especially effective manner while avoiding disadvantageous cold welds. To this end, "dry coating" is implemented in the particular desired press-fitting region a, b, c, a', b', c, in which press-fitting region a, b, c, a', b', c' is treated by an industrial cleaning agent and a cleaning additive, e.g., SurTec®, during a cleaning operation. The cleaning of the specifically selected components 2, 5, 6, 44 takes place by, for instance, dipping, spraying or sprinkling. Ideally, a 5 to 10% SurTec® 104 solution is used for treating press-fitting regions a, b, c, a', b', c'. As an alternative, it is also possible to use a Hitec solution (e.g., Hitec® E536 of the Ethyl Corp.) at 5-30%, dissolved in test fluid for injection assemblies. Score marks 61 in the particular press-fitting region a, b, c, a', b', c' are used as lubricant reservoirs.

As an alternative to the all-purpose cleaner SurTec® 104, it is also possible to use, for instance, the modular all-purpose cleaner SurTec® 089 consisting of tenside components. This cleaner with tensides and anti-corrosion components is particularly suitable for cleaning by dipping. Due to the treatment with such all-purpose cleaners, metallic components 2, 5, 6, 44 are already cleaned prior to installation and protected against corrosion by a passivation. The drying of components 2, 5, 6, 44 following the cleaning operation is accomplished by the use of vacuum dryers, for example.

What is claimed is:

1. A fuel injector for a fuel-injection system of an internal combustion engine, comprising:

a valve having a longitudinal valve axis;

an excitable actuator to actuate a valve-closure element of the valve, which cooperates with a valve-seat surface provided on a valve-seat body, and having at least one spray-discharge opening; and metallic components firmly connected to one another using pressure, thereby forming a firm press-fitted connection of at least two of said metallic components, wherein a press-fitting region of the at least one metallic component includes a structure with score marks, wherein, beginning in the press-fitting region of the at least one metallic component, a recessed region adjoins first and is followed by a press lip that radially projects further toward an outside at an outer contour of the at least one metallic component, thereby forming an enclosed cavity bounded by the press-fitting region of the at least one metallic component, the recessed region, the press lip, and a press-fitting region of another of the at least two metallic components;

wherein the recessed region extends deeper in a radial direction than the score marks, such that the enclosed cavity is configured to retain abraded particles.

2. The fuel injector of claim 1, wherein the recessed region is formed in a shape of a groove.

3. The fuel injector of claim 1, wherein the transitions (i) from the press-fitting region to the recessed region, and (ii) from the recessed region to the press lip extend one of (i) in rounded form, at an incline similar to a chamfer, or (ii) in a form of a step.

4. The fuel injector of claim 1, wherein one of the following is satisfied:

(i) an outer diameter of the press lip corresponds to an outer diameter of the press-fitting region, or (ii) the outer diameters of the press lip and the press-fitting region differ.

5. The fuel injector of claim 1, wherein the score marks in the press-fitting region are circumferential.

6. The fuel injector of claim 1, wherein one of the metallic components is a thin-walled valve sleeve for which at least one of the following is satisfied:

(i) a connection pipe is pressed in place into the sleeve, (ii) a core is pressed in place into the sleeve, and (iii) a valve cover is pressed into place onto the sleeve.

7. The fuel injector of claim 1, wherein the metallic components connected to one another by the firm press-fitted connection are made from at least one of a stainless steel and a magnetically soft chromium steel.

8. A fuel injector for a fuel-injection system of an internal combustion engine, comprising:

a valve having a longitudinal valve axis;

an excitable actuator to actuate a valve-closure element of the valve, which cooperates with a valve-seat surface provided on a valve-seat body, and having at least one spray-discharge opening; and metallic components firmly connected to one another using pressure, thereby forming a firm press-fitted connection of at least two of said metallic components, wherein at least one of the at least two metallic components satisfies at least one of the following:

(i) a press-fitting region of the at least one metallic component includes a structure with score marks, and (ii) the press-fitting region has a rounded intake in at least one transition to an adjoining component section, wherein, beginning in the press-fitting region of the at least one metallic component, a recessed region adjoins first and is followed by a press lip that radially projects further toward an outside at an outer contour of the at least one metallic component, thereby forming an enclosed cavity bounded by the press-fitting region of the at least one metallic component, the recessed region, the press lip, and a press-fitting region of another of the at least two metallic components;

wherein a first component of the at least two metallic components includes the structure with score marks in the press-fitting region, and a second component of the at least two metallic components includes the rounded intake in at least one transition to the adjoining component section in the press-fitting region, wherein the press-fitting region of the first component projects radially further than adjoining component sections, and the rounded intake of the second component includes a radius which corresponds to an angularity of 0.5° to 1.2°.

9. The fuel injector of claim 1, wherein the press-fitting region has a rounded intake in at least one transition to an adjoining component section.

10. The fuel injector of claim 1, wherein the recessed region has at least two depths.

* * * * *